US005337771A

United States Patent [19]

Berges et al.

[11] Patent Number: 5,337,771

[45] Date of Patent: Aug. 16, 1994

[54] UMBRELLA WITH AN IMPROVED HANDLE

[75] Inventors: Rüdiger Berges; Ulrich Berges, both of Germering, Fed. Rep. of Germany

[73] Assignee: Rudiger Berges GmbH, Germering, Fed. Rep. of Germany

[21] Appl. No.: 102,636

[22] Filed: Aug. 5, 1993

[30] Foreign Application Priority Data

Aug. 17, 1992 [DE] Fed. Rep. of Germany .... 9210999[]

[51] Int. Cl.[5] ..... A45B 19/00

[52] U.S. Cl. ..... 135/25.4; 135/76

[58] Field of Search ..... 135/25.4, 25.41, 72, 135/76; 280/821, 823

[56] References Cited

U.S. PATENT DOCUMENTS

| | | | |
|---|---|---|---|
| 1,587,475 | 6/1926 | Davis | 135/25.41 X |
| 1,600,046 | 9/1926 | Goldwin | 135/76 |
| 1,937,363 | 11/1933 | Seraphim | 135/25.41 |
| 3,556,544 | 1/1971 | Hauser | 280/823 |

FOREIGN PATENT DOCUMENTS

| | | | |
|---|---|---|---|
| 1632527 | 1/1971 | Fed. Rep. of Germany | 135/25.41 |
| 0599955 | 1/1926 | France | 135/25.41 |
| WO9011031 | 4/1990 | PCT Int'l Appl. . | |
| 165184 | 1/1934 | Switzerland | 280/823 |

*Primary Examiner*—Carl D. Friedman
*Assistant Examiner*—Lan C. Mai

[57] ABSTRACT

An umbrella is described which has a handle (1) which is secured to an upper end part (3) of the umbrella stock (2) via a joint (4) in such a way that it can be pivoted between a position at least approximately aligned with the direction of the stock axis and a position at an angle of approximately 50° to 90° to the stock axis. The end part preferably has the same diameter as the adjacent grip region of the handle and serves as an extension of the grip region. In the grip region of the end part can be secured a snap-on shell which enables the umbrella to be grasped comfortably and securely.

9 Claims, 5 Drawing Sheets

S-S
A
A

R
A-A
17
R
R-R

K-K

B
2a
2
2b
3
K
9
S
1
4
7
6
S
8
5
B
K

UMBRELLA WITH AN IMPROVED HANDLE

The invention relates to an umbrella with a handle arranged at variance to the direction of the axis of the stock or shaft of the umbrella.

Conventional umbrellas normally have a handle arranged at variance to the stock axis, the handle being bent for example in a semi-circular shape. Umbrellas are also known in which the handle is aligned with the stock axis and in which the upper end of the handle for example is ball-shaped.

Umbrellas with a bent or angled handle have the advantage of better positioning in the hand and are more comfortable to grasp. However, this type of umbrella has the drawback of being relatively bulky during storage and transport, which can be of significance especially when shipping individual umbrellas or when shipping very large numbers, especially with regard to the cost of shipping umbrellas which are mass-produced and, because of their low price tags, one does not wish to make more expensive through additional costs of this type.

It is an object of the invention to improve conventional umbrellas in such a way that on the one hand they are most practical in handling and on the other hand present the lowest possible volume for shipping. According to the invention, this object is achieved through the subject of claim 1. Preferred further developments of the invention are the subject of the sub-claims.

A particular advantage of such a construction can be seen when for example an umbrella according to the invention can be held more comfortably when the handle is in the horizontal position. To a certain extent this compensates for different body heights of the users. This applies not only to longer umbrellas which are used as walking sticks, but also when used in the opened state where, for example, a child can hold more comfortably and securely the upper end of the umbrella stock which has approximately the same diameter as the handle. This also applies to the grasping of relatively short stock lengths, i.e. when the umbrella is insufficiently long for it to be used like a walking stick. A further advantage consists in that many users of utility articles get pleasure from being able to make different adjustments and thus surprise their friends that for apparently inexplicable reasons the handle no longer aligns with the stock axis. From a cost point of view the low shipping volume is particularly important, as the shipping costs form a substantial part in the calculation of the retail price for relatively bulky, mass-produced goods.

Figure 1:
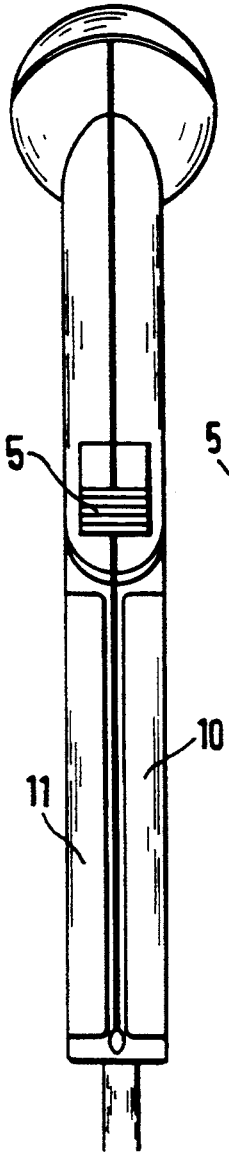
Figure 2:
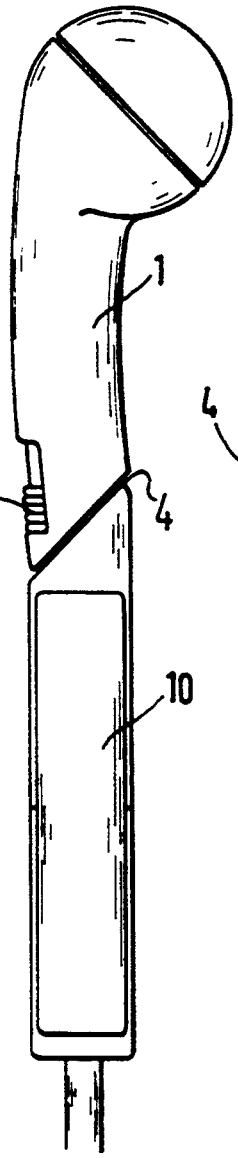
Figure 3:
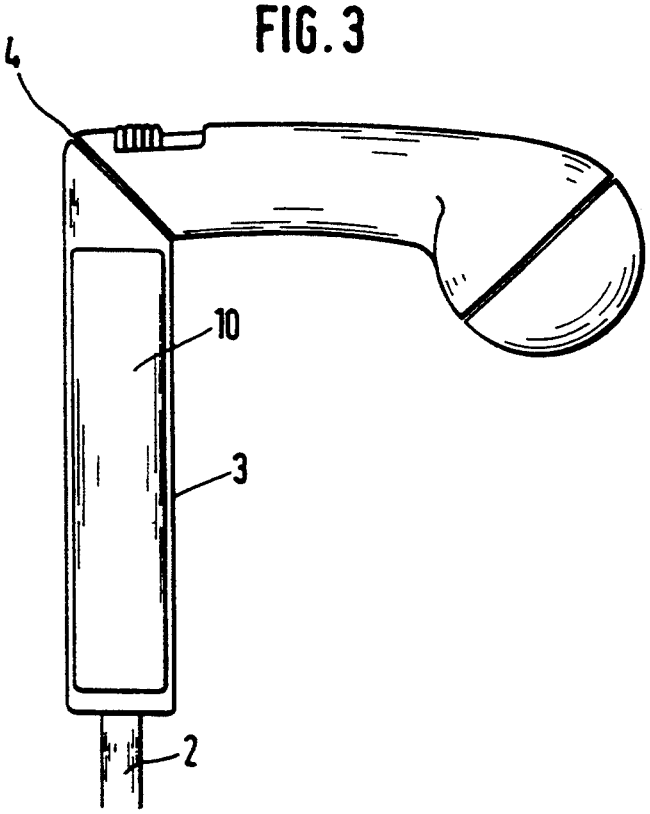
Figure 4:
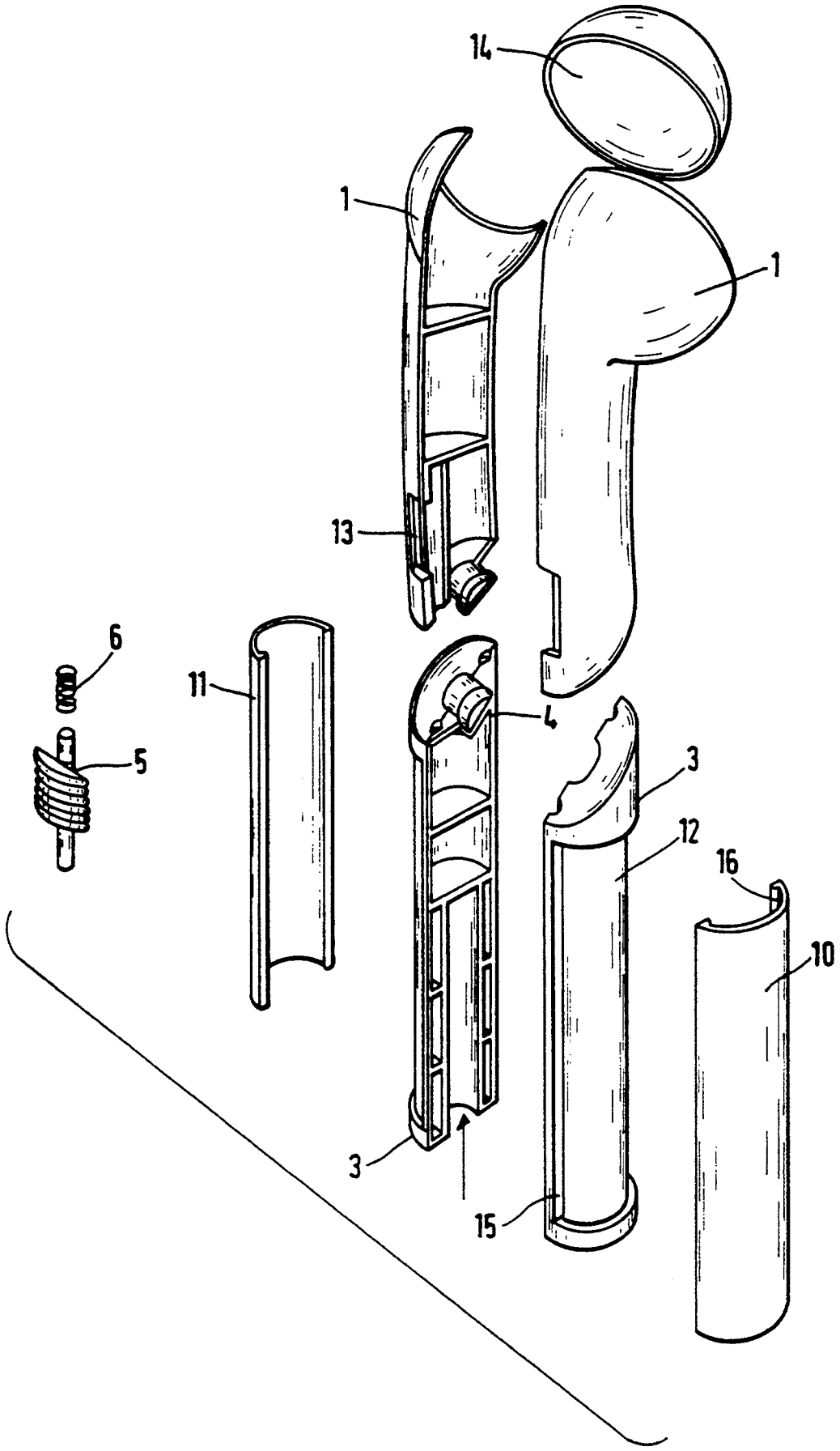
Figure 5A:
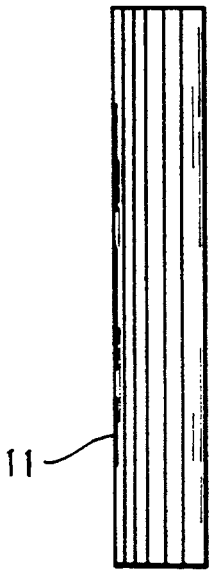
Figure 5B:
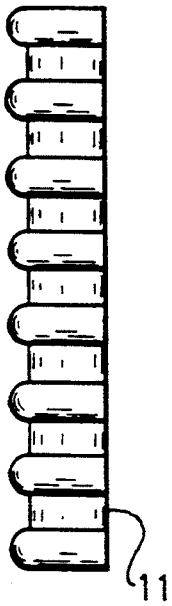
Figure 5C:
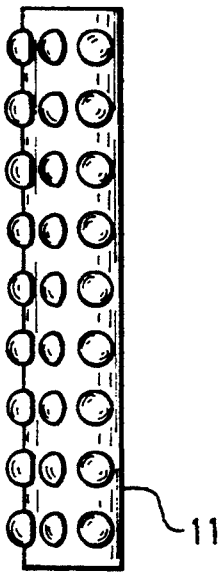
Figures 6A, 6B, 6C, 6D, 6E:
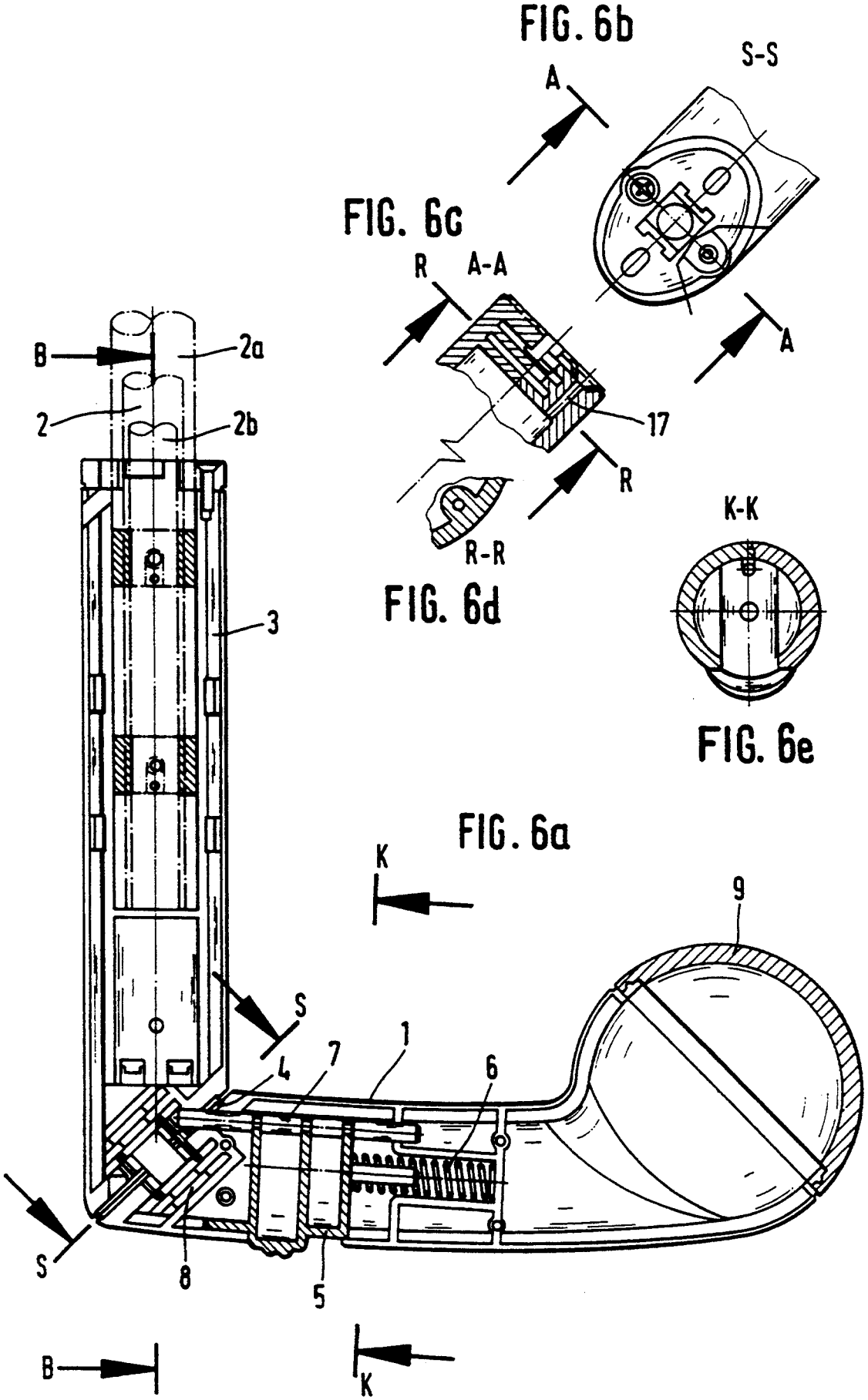

The invention is described by way of example in more detail with the aid of the drawings, in which:

FIG. 1 and 2 show side views displaced by 90° to each other, of the top end of an umbrella according to the invention with the handle in the aligned position, FIG. 3 shows a side view of the umbrella in FIG. 1 and 2 with the handle in the angular position, FIG. 4 shows an exploded view of the umbrella in FIGS. 1 to 3 which serves to clarify the development of the elements in this embodiment, FIGS. 5*a*, 5*b* and 5*c* show side views of different snap-on shells, showing a variety of exterior finishes, FIG. 6 shows a sectional view of a detailed embodiment according to FIG. 1 to 3, FIG. 6*b* shows a section along the line S—S of FIG. 6*a;*

FIG. 6*c* shows a sectional view along the line a—a of FIG. 6*b;*

FIG. 6*d* shows a sectional view along the line r–r of FIG. 6*c;*

FIG. 6*e* shows a sectional view along the lines k—k of FIG. 6*a;*

Figure 7A:
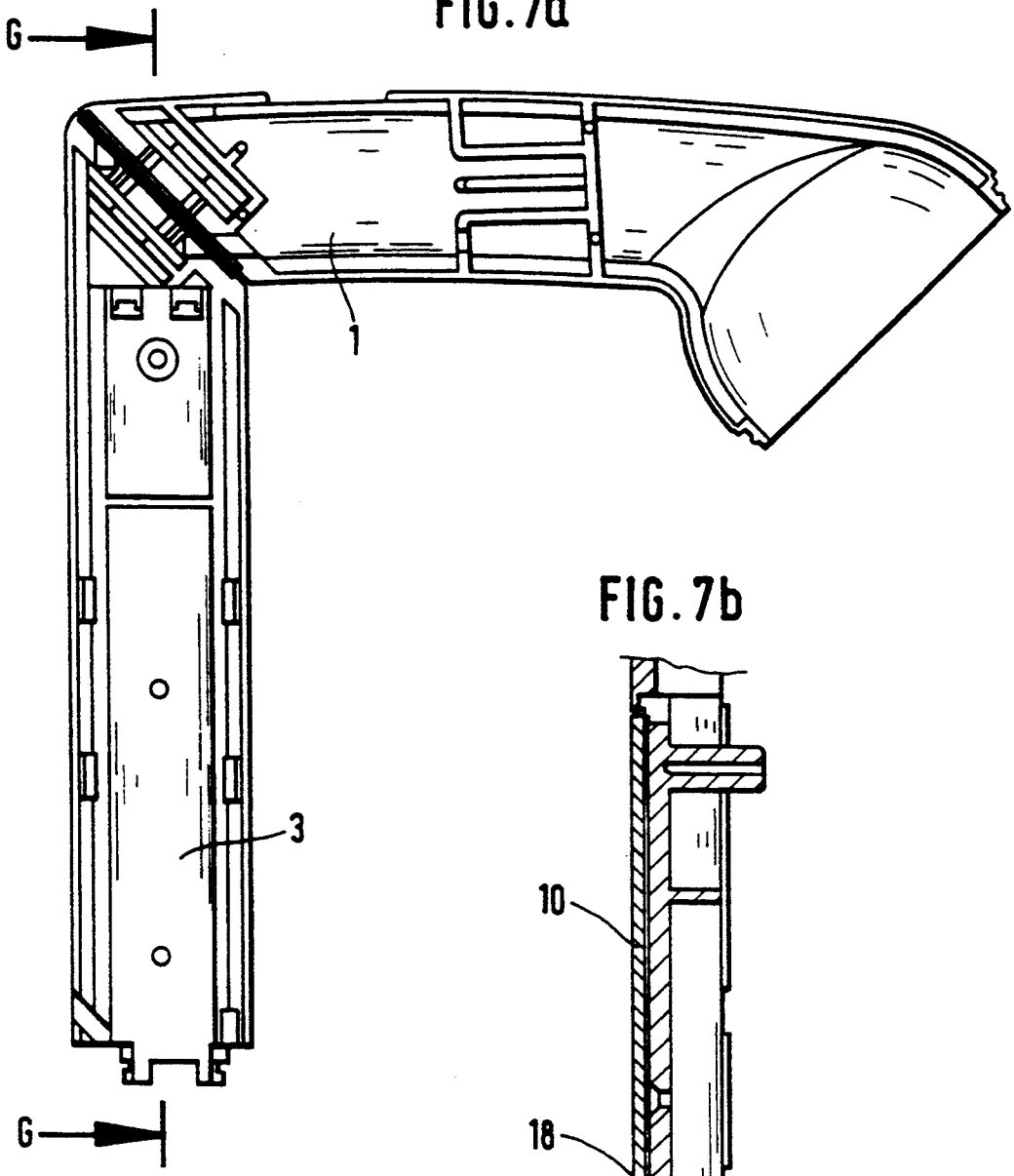

FIG. 7*a* shows the upper half associated with FIG. 6*a* and

Figure 7B:
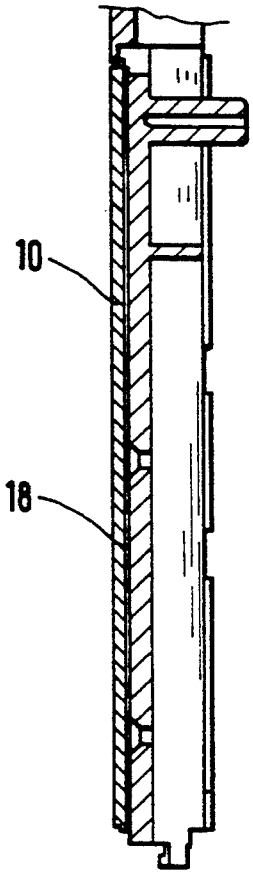

FIG. 7*b* shows a sectional view along the line G—G in FIG. 7*a.*

The embodiment shown in FIGS. 1 to 4 shows the upper end of the umbrella or parasol, as the lower end of the umbrella can be constructed in the conventional manner.

The umbrella shown in the Figs. has a handle 1 and an umbrella stock 2 whose upper end part 3 is constructed in such a way that on the one hand the umbrella stock can be inserted into the lower end of the end part 3, as indicated by the arrow in FIG. 4, whilst on the other hand the upper end of the end part 3 is connected via a joint 4 with the lower end of the handle 1. The joint 4 can be a standard or similar ball joint, so that the handle can be pivoted from the position shown in FIGS. 1 and 2 into a position shown in FIG. 3 in which the handle at least approximately aligns with the direction of the stock axis. Instead of the 90° offset position shown in FIG. 3, the preferred position, the handle 1 can also be adjusted from the position shown in FIGS. 1 and 2 to any desirable angular position e.g. between a few degrees and 90 degrees or more, preferably between approximately 50° and 90°.

In the adjusted positions shown in FIG. 1 and 2 or FIG. 3 and if necessary intermediate positions it is possible to lock the handle by means of a fixing element 5.

The upper end part 3 of the umbrella stock allows for aesthetic shaping of the top end of the umbrella. The end part 3, which like the handle 1 is made for example of plastics, can be used as the grip region and a snap-on shell 10 can be attached by snapping-in to a recess 12 (FIG. 4) of the end part 3. A second snap-on shell 11, opposite the first snap-on shell 10, may also be inserted in a corresponding recess of the end part 3. The snap-on shells consist of transparent plastics material, but may also be made from nontransparent plastics. Different snap-on shells can be supplied with the umbrella in accordance with the buyers' wishes and these can be snapped in place by the users themselves. A transparent snap-on shell 10 is preferably used beneath which the user can place a tag with his name and address. Since the snap-on shell can be constructed in such a way that it cannot be easily removed or at least not without destroying it, the possibility for personalised inscriptions has obvious advantages for the owner of the umbrella. On the other hand the surface beneath the snap-on shells can otherwise be used in any desirable manner for the purpose of advertising or simply for affixing decorations, club badges etc.

The upper end part 3 of the umbrella stock 2 is preferably constructed in such a way that it has approximately the same diameter as the adjacent grip region of the handle piece 1 and can therefore serve as an extension of the grip region. This further improves the handling of the umbrella because a comfortable gripping surface is provided not only on the handle itself, but also along the length of the end part 3 of the umbrella stock. By attaching the snap-on shells 10, 11 in the grip region of the end piece 3 it is additionally possible to achieve a comfortable or improved feel when grasping the umbrella, for example when snap-on shells are used which have linear or grid-like projections on their surfaces. Small children especially would then also be able to grip the end region of the end part 3 which they can reach better than the actual handle 1. Embodiments of different developments of the surfaces for the snap-on shells 10 or 11 are shown in FIGS. 5*a, b* and *c*.

The drawing in FIG. 4 shows an embodiment of a development of the joint 4. The joint can be of any conventional type such as for example a ball joint which is constructed in such a way that through this the handle 1 can be secured to the upper end 3 of the umbrella stock 2 and the handle 1 can be pivoted into a position at least approximately aligned with the direction of the stock axis. Advantageously the handle 1 has a fixing element 5 in the form of a fixing slider through which the handle can be locked in the selected pivot position. The fixing element 5 arranged in a recess 13 of the handle 1 is prestressed in the locked position by a spring 6.

The snap-on shells 10 or 11 for example are half shells with a circular arc length having a central angle of approximately 180° or less and enable the snapping-in in a holding groove 15 which runs on both sides along the recess 12 for inserting the relevant snap-on shell 10 which advantageously in each case has a snap-in projection 16 along its two side edges.

The ball-shaped handle 1 preferably provided at the upper end of the handle 1, like the handle 1 can be constructed solidly in one piece, or may consist of a hollow body with a detachable cap 14 or 9. When using a detachable cap there is also the advantage that by using different coloured plastics for the elements of the handle and the end part with the snap-on shell the looks of the umbrella can be improved by selecting a suitable colour contrast. Whilst the arrangement of a snap-on shell 10 in the grip region of the end part 3 is preferred, suitable construction of the handle 1 can also result in the snap-on shell 10 being arranged in the grip region of the handle 1.

In the FIGS. 6 and 7 is shown a detailed embodiment in a pivot position according to FIG. 3. The sectional view in FIG. 6*a* shows the lower half of the handle 1 and the end part 3, whilst the sectional view in FIG. 7*a* shows the corresponding upper half of the handle 1 and the end part 3. Instead of the umbrella stock 2 shown in FIG. 3, there may be provided an umbrella stock 2*a* with larger diameter or an umbrella stock 2*b* with smaller diameter.

As shown in FIG. 6*a*, the joint 4 has joint elements 8 and the fixing device with the fixing element 5 is provided with a locking element 7. On the end of the handle 1 is secured a ball-shaped cap 9. Special sectional views are shown in FIG. 6*b* and 7*b*. In FIG. 7*b* beneath the snap-on shell 10 is arranged an insert 16 which can be written or typed on.

We claim:

1. An umbrella of the type having an elongated stock attached to a handle, said umbrella having a central axis, said handle comprising:

a first part having one end portion for receiving said shaft and a second end portion truncated at an angle with respect to the central axis of the umbrella, said first part comprising two molded plastic halves, said halves being separated longitudinally and assembled to form said first part, each said half having a generally cylindrical recess having a retaining groove which runs on both sides of the recess;

for each said halve, a shell having a circular arc length of less than approximately 180 degrees and terminating in side edges, said sides edges each having a snap projection which mates with the retaining groove to permit the shell to be attached to its respective half;

a second part having an end that is truncated at an angle with respect to said central axis, said truncated end portion of said second part being disposed in face to face relation with said truncated end of said first part;

a pivot mechanism disposed between said truncated ends of said first and second parts, said pivot mechanism permitting the second portion to pivot from a first position substantially parallel to said stock to a second position substantially perpendicular to said stock;

a locking mechanism for securing said second part in the first or second position, said locking mechanism comprising a pair of openings in one of said truncated ends, said openings receiving a locking pin, said locking pin being spring biased to a position where it is inserted within one of the holes to lock the first part into position with respect to the second part, said locking pin being moveable against said bias to a position wherein it is withdrawn from said openings to permit said first second part to pivot with respect to said first part, said bias forcing said pin against the truncated end of the opposite part during the pivoting motion, and then finally into one of said openings to lock the two parts in fixed relation, thereby permitting single finger operation of said locking mechanism.

2. An umbrella according to claim 1 wherein said openings are located on said truncated end of said first part and wherein said locking pin is spring biased out of said second part.

3. An umbrella according to claim 2 wherein said second part comprises a plastic handle formed into two halves, said halves separated longitudinally and including a hollow chamber for receiving said pin, said pin being attached to a fixing element, said fixing element extending through an opening in at least one of said halves to permit finger actuation.

4. An umbrella according to claim 1 wherein at least one of said shells is transparent, and wherein said cylindrical surface of said first part includes a space for receiving indicia, said indicia being visible through said shell once it is snapped onto said first part.

5. An umbrella according to claim 1 wherein said umbrella comprises a plurality of pairs of shells, each pair having a different outer surface, said shell permitting a user to select different appearances for the outer surface of said first part.

6. An umbrella according to claim 1 wherein said second part has a second end having a hollow therein, said second end further including a ball shaped detachable cap to facilitate storage.

7. An umbrella according to claim 6 wherein said second part has a longitudinal axis, and wherein said hollow and said detachable cap is offset with respect to said longitudinal axis, said offset being directed towards said stock when said second part is locked in a position perpendicular to said first part thereby permitting the handle to be carried over the user's arm without slipping sidewardly.

8. An umbrella of the type having an elongated stock attached to a handle, said umbrella having a central axis, said handle comprising:

a first part having one end portion for receiving said shaft and a second end portion truncated at an angle with respect to the central axis of the umbrella;

a second part having an end that is truncated at an angle with respect to said central axis, said truncated end portion of said second part being disposed in face to face relation with said truncated end of said first part;

a pivot mechanism disposed between said truncated ends of said first and second parts, said pivot mechanism permitting the second portion to pivot from a first position substantially parallel to said stock to a second position substantially perpendicular to said stock;

a locking mechanism for securing said second part in the first or second position, said locking mechanism comprising a pair of openings in one of said truncated ends, said openings receiving a locking pin, said locking pin being spring biased to a position where it is inserted within one of the holes to lock the first part into position with respect to the second part, said locking pin being moveable against said bias to a position wherein it is withdrawn from said openings to permit said first second part to pivot with respect to said first part, said bias forcing said pin against the truncated end of the opposite part during the pivoting motion, and then finally into one of said openings to lock the two parts in fixed relation, thereby permitting single finger operation of said locking mechanism.

9. An umbrella of the type having an elongated stock attached to a handle, said umbrella having a central axis, said handle comprising:

a first part having one end portion for receiving said shaft and a second end portion truncated at an angle with respect to the central axis of the umbrella, a second part having an end that is truncated at an angle with respect to said central axis, said truncated end portion of said second part being disposed in face to face relation with said truncated end of said first part;

a pivot mechanism disposed between said truncated ends of said first and second parts, said pivot mechanism permitting the second portion to pivot from a first position substantially parallel to said stock to a second position substantially perpendicular to said stock;

a locking mechanism for securing said second part in the first or second position, said locking mechanism comprising a pair of openings in one of said truncated ends, said openings receiving a locking pin, said locking pin being spring biased to a position where it is inserted within one of the holes to lock the first part into position with respect to the second part, said locking pin being moveable against said bias to a position wherein it is withdrawn from said openings to permit said first second part to pivot with respect to said first part, said bias forcing said pin against the truncated end of the opposite part during the pivoting motion, and then finally into one of said openings to lock the two parts in fixed relation;

said second part having a longitudinal axis and having a second end having a hollow therein, said second end further including a ball shaped detachable cap to facilitate storage; said hollow and said detachable cap being offset with respect to said longitudinal axis, said offset being directed towards said stock when said second part is locked in a position perpendicular to said first part thereby permitting the handle to be carried over a user's arm without slipping sidewardly.

* * * * *